US011577128B2

(12) United States Patent
Shindo

(10) Patent No.: US 11,577,128 B2
(45) Date of Patent: Feb. 14, 2023

(54) GOLF BALL AND METHOD OF MANUFACTURE

(71) Applicant: Bridgestone Sports Co., Ltd., Tokyo (JP)

(72) Inventor: Jun Shindo, Saitamaken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 17/124,567

(22) Filed: Dec. 17, 2020

(65) Prior Publication Data

US 2021/0187360 A1 Jun. 24, 2021

(30) Foreign Application Priority Data

Dec. 20, 2019 (JP) ..... JP2019-230467

(51) Int. Cl.
*A63B 37/06* (2006.01)
*A63B 37/14* (2006.01)
*A63B 37/00* (2006.01)

(52) U.S. Cl.
CPC ..... *A63B 37/0051* (2013.01)

(58) Field of Classification Search
CPC ..... A63B 37/0038; A63B 37/0039; A63B 37/005; A63B 37/006; A63B 37/00621; A63B 37/00622
USPC ..... 473/351–378
See application file for complete search history.

(56) References Cited

U.S. PATENT DOCUMENTS 4,546,980 A * 10/1985 Gendreau ..... A63B 37/0083 525/274
5,019,319 A * 5/1991 Nakamura ..... A63B 37/0074 473/371
5,244,969 A * 9/1993 Yamada ..... C08L 23/0876 525/196
5,412,045 A * 5/1995 Osman ..... C08F 136/06 526/133
6,565,455 B2 * 5/2003 Hayashi ..... A63B 37/12 473/378
6,565,456 B2 * 5/2003 Hayashi ..... A63B 37/0003 473/378

(Continued)

FOREIGN PATENT DOCUMENTS

EP 2668979 B1 * 1/2017 ..... A63B 37/0003
JP 05317459 A * 12/1993

(Continued)

*Primary Examiner* — Alvin A Hunter
(74) *Attorney, Agent, or Firm* — Sughrue Mion, PLLC

(57) ABSTRACT

In a golf ball having a core composed of one or more layer, the outermost layer of the core is formed of a rubber composition containing an α,β-unsaturated metal carboxylate, and an envelope layer directly encasing the core is formed of a resin composition containing a thermoplastic resin having a structure that includes α,β-ethylenically unsaturated carboxylic acid copolymerization units. The infrared absorption spectra at surface sites on the outermost layer of the core, as measured by ATR FT-IR spectroscopy, satisfy a specific condition. The ball has an enhanced adhesion between the rubber-based core and the adjacent cover layer that is formed of an ionomer resin or other α,β-ethylenically unsaturated carboxylic acid copolymer-containing resin material.

13 Claims, 1 Drawing Sheet

(56) References Cited

U.S. PATENT DOCUMENTS 6,723,008 B2 * 4/2004 Higuchi ..... A63B 37/0076 473/378
6,746,345 B2 * 6/2004 Higuchi ..... A63B 37/0083 473/378
6,786,839 B2 * 9/2004 Hayashi ..... A63B 37/06 473/377
6,824,478 B2 * 11/2004 Hayashi ..... A63B 37/06 473/377
6,838,501 B2 * 1/2005 Takesue ..... A63B 37/0003 473/378
6,875,132 B2 * 4/2005 Hayashi ..... C08K 5/14 473/473
6,894,097 B2 * 5/2005 Takesue ..... C08K 5/09 524/400
6,962,951 B1 * 11/2005 Takesue ..... A63B 37/0003 524/400
6,981,925 B2 * 1/2006 Shimizu ..... A63B 37/0003 473/376
7,084,198 B2 * 8/2006 Takesue ..... C08K 5/09 524/400
7,118,494 B2 * 10/2006 Higuchi ..... A63B 37/0045 473/373
7,160,940 B2 * 1/2007 Hayashi ..... C08K 5/14 525/274
7,425,182 B1 * 9/2008 Nanba ..... A63B 37/0024 473/376
7,445,565 B2 * 11/2008 Komatsu ..... A63B 37/0064 473/373
7,488,262 B1 * 2/2009 Nanba ..... A63B 37/0076 473/376
7,559,856 B2 * 7/2009 Shindo ..... A63B 37/0023 473/378
7,625,301 B2 * 12/2009 Komatsu ..... A63B 37/00622 473/374
7,740,547 B2 * 6/2010 Nanba ..... A63B 37/0043 473/376
7,744,492 B2 * 6/2010 Nanba ..... A63B 37/0031 473/376
7,819,760 B2 * 10/2010 Sullivan ..... A63B 37/0063 473/373
7,867,419 B2 * 1/2011 Ohira ..... A63B 45/00 427/302
7,946,933 B2 * 5/2011 Nanba ..... A63B 37/0003 473/373
7,959,524 B2 * 6/2011 Nanba ..... A63B 37/0024 473/373
8,419,571 B2 * 4/2013 Ohira ..... A63B 45/00 427/302
8,905,859 B2 * 12/2014 Higuchi ..... A63B 37/0051 473/371
8,932,151 B2 * 1/2015 Higuchi ..... A63B 37/0029 473/371
9,005,049 B2 * 4/2015 Shinohara ..... C09D 175/04 473/371
9,044,644 B2 * 6/2015 Shinohara ..... A63B 37/0084
9,545,543 B2 * 1/2017 Mochizuki ..... A63B 37/0096
9,776,046 B2 * 10/2017 Tajima ..... A63B 37/0024
9,975,007 B2 * 5/2018 Shindo ..... A63B 37/0031
2002/0010037 A1 * 1/2002 Nesbitt ..... A63B 37/04 473/371
2002/0013184 A1 1/2002 Morgan
2013/0165268 A1 6/2013 Tajima et al.
2016/0206932 A1 * 7/2016 Mochizuki ..... A63B 37/0027
2017/0136311 A1 5/2017 Binette et al.
2017/0173399 A1 * 6/2017 Tajima ..... A63B 37/0027
2019/0388735 A1 * 12/2019 Mochizuki ..... A63B 37/0024
2021/0187360 A1 * 6/2021 Shindo ..... A63B 37/0063

FOREIGN PATENT DOCUMENTS

JP 2866298 B2 * 12/1998
JP 2000086816 A * 3/2000
JP 2000136266 A * 5/2000 ..... A63B 37/0033
JP 2003-79766 A 3/2003
JP 2003-339912 A 12/2003
JP 4022694 B2 * 12/2007 ..... A63B 37/0003
JP 4054971 B2 * 3/2008
JP 2013-132312 A 7/2013
JP 2013-150689 A 8/2013
JP 2013-150690 A 8/2013
JP 2014-90957 A 5/2014
JP 2014090957 A * 5/2014
JP 5663832 B2 * 2/2015 ..... A63B 45/00
JP 2017-99864 A 6/2017

* cited by examiner

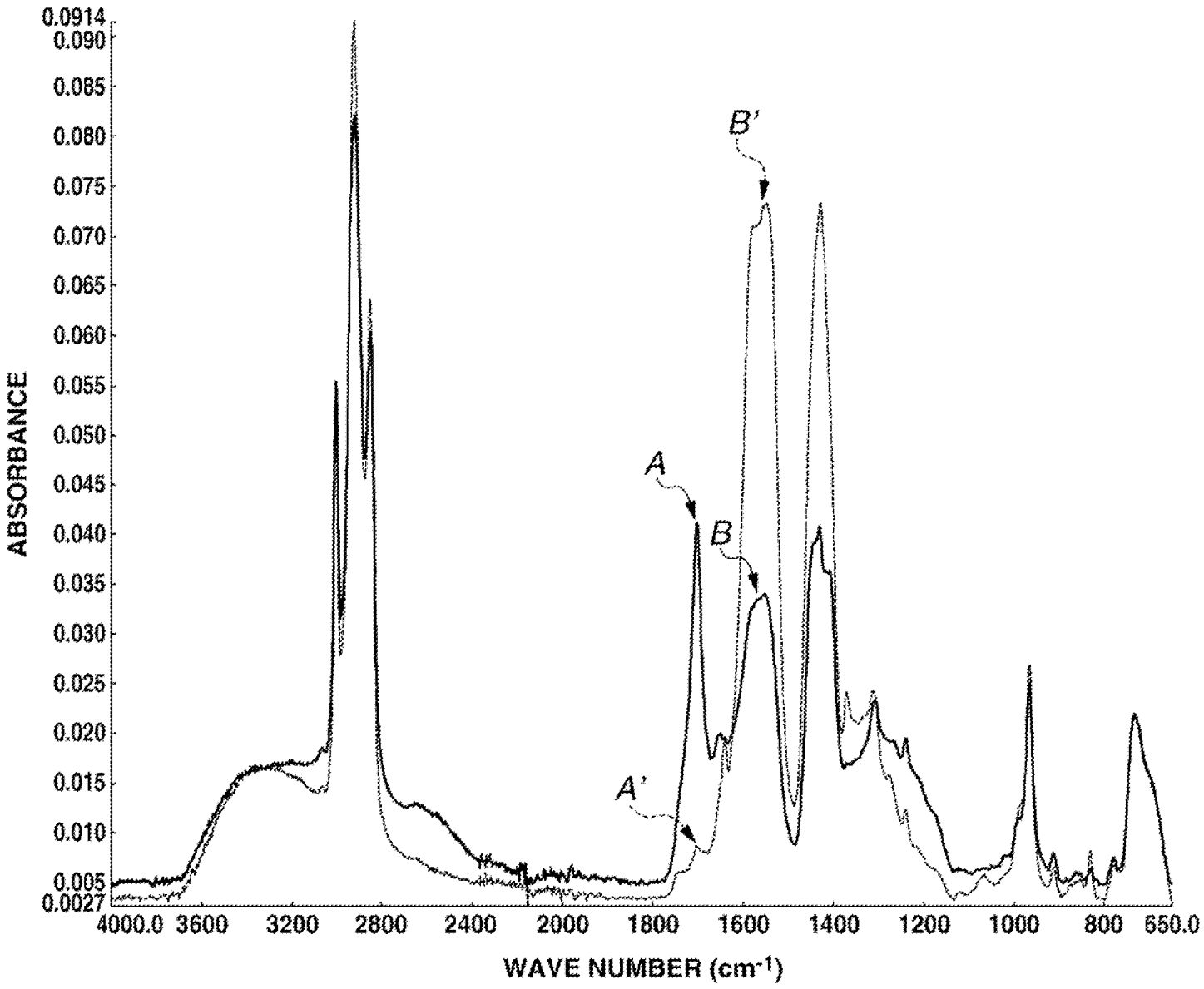
ABSORBANCE
0.0914
0.090
0.085
0.080
0.075
0.070
0.065
0.060
0.055
0.050
0.045
0.040
0.035
0.030
0.025
0.020
0.015
0.010
0.005
0.0027
4000.0
3600
3200
2800
2400
2000
1800
1600
1400
1200
1000
800
650.0
WAVE NUMBER (cm-1)
A
A'
B
B'

GOLF BALL AND METHOD OF MANUFACTURE

CROSS-REFERENCE TO RELATED APPLICATION

This non-provisional application claims priority under 35 U.S.C. § 119(a) on Patent Application No. 2019-230467 filed in Japan on Dec. 20, 2019, the entire contents of which are hereby incorporated by reference.

TECHNICAL FIELD

The present invention relates to a golf ball having a core of one or more layer and a cover of one or more layer which encases the core, and to a method of manufacturing such a golf ball. More specifically, the invention relates to a golf ball in which adhesion between the outermost layer of the core and the adjacent cover layer is enhanced, and to a method of manufacture thereof.

BACKGROUND ART

Solid golf balls with a multilayer structure of three or more pieces have been commonly used in recent years. These multilayer golf balls are generally produced by consecutively injection-molding synthetic resin cover materials around a core so as to form successive layers over the core. However, when adhesion between the layers of the golf ball is poor, this may adversely affect ball properties such as flight, spin on approach shots, feel at impact and durability to cracking. Accordingly, there is a desire for adhesion between these layers to be enhanced.

There already exists numerous art for enhancing adhesion between the layers of a golf ball in order to improve the durability of the ball to impact. In particular, it is common for the core to be formed of a rubber composition and for each cover layer to be formed of a resin material such as an ionomer resin or a thermoplastic elastomer. Because the outermost layer of the core and the adjacent cover layer are formed of differing materials—rubber in the case of the former and a resin in the case of the latter, several technical disclosures have been made in which adhesion between the layers of a golf ball is enhanced by surface-treating the outermost layer of the core. For example, JP-A 2017-099864 describes art which, in order to impart a good interlayer adhesion between adjacent differing layers of a golf ball, carries out surface treatment between the layers with a silane-containing adhesion promoter. JP-A 2013-132312 and JP-A 2014-090957 disclose art in which an aqueous adhesion-promoting treatment is applied to the surface of a golf ball core. JP-A 2013-150690 discloses art which treats the surface of a golf ball core with a urethane resin emulsion, and JP-A 2013-150689 discloses art in which the surface of a golf ball core is treated with rubber latex. Additional art includes JP-A 2003-079766, which subjects the inner cover layer of a golf ball to halogenation, chemical surface treatment or surface treatment with UV irradiation or the like; and JP-A 2003-339912 which, in the production of a golf ball, carries out acid treatment on an intermediate layer made of an ionomeric resin material, thereby enhancing adhesion with an outermost layer made of a polyurethane resin material.

However, when the cover layer adjacent to the rubber core is formed of a resin material containing an α,β-ethylenically unsaturated carboxylic acid copolymer such as an ionomer resin, adhesion between the core and the cover layer is still inadequate, and so there remains room for improvement in the durability to cracking. That is, the prior art lacks a fully effective method for enhancing adhesion between a core composed primarily of rubber and an ionomer resin layer directly encasing the core, and ultimately increasing the durability of the golf ball.

SUMMARY OF THE INVENTION

It is therefore one object of the present invention to provide a golf ball in which adhesion is enhanced between a core composed primarily of rubber and a cover layer which directly encases the core and is formed of a resin material that includes an α,β-ethylenically unsaturated carboxylic acid copolymer such as an ionomer resin, thereby increasing the durability of the ball. A further object of the invention is to provide a method for producing such a golf ball.

As a result of extensive investigations. I have found that by forming the outermost layer in a golf ball core of a rubber composition containing a base rubber and an α,β-unsaturated metal carboxylate, forming an envelope layer directly encasing the core of a resin composition containing a thermoplastic resin having a structure that includes α,β-ethylenically unsaturated carboxylic acid copolymerization units and, when the infrared absorption spectra at surface sites on the outermost layer of the core are measured by attenuated total reflectance Fourier transform infrared (ATR FT-R) spectroscopy, letting A be the absorbance peak height near a wave number of 1700±40 $cm^{-1}$ (height of absorbance peak attributed to carboxylic acid) and B be the absorbance peak height near a wave number of 1550±40 $cm^{-1}$ (height of absorbance peak attributed to metal carboxylate), by having the value expressed as A/(A+B) at some or all of the surface sites be 0.4 or more, adhesion between the core surface and the envelope layer positioned outside thereof is enhanced.

In addition, I have discovered that by having a method for producing a golf ball which has a core composed of one or more layer include the steps of forming a core outermost layer with a rubber composition containing a base rubber and an α,β-unsaturated metal carboxylate, surface-treating the core outermost layer by bringing an acid-containing solution into contact with the surface of this layer, and forming an envelope layer by molding, over the surface-treated outermost layer of the core, a resin composition containing a thermoplastic resin having a structure that includes α,β-ethylenically unsaturated carboxylic acid copolymerization units, adhesion between the core surface and the outwardly adjacent envelope layer can be enhanced without adversely affecting properties of the core surface by what is, in chemical surface treatment of the core surface, a relatively simple and inexpensive method.

Accordingly, in a first aspect, the present invention provides a golf ball having a core composed of one or more layer, wherein an outermost layer of the core is formed of a rubber composition containing a base rubber and an α,β-unsaturated metal carboxylate, an envelope layer which directly encases the core is formed of a resin composition containing a thermoplastic resin having a structure that includes α,β-ethylenically unsaturated carboxylic acid copolymerization units, and when the infrared absorption spectra at surface sites on the outermost layer of the core are measured by attenuated total reflectance Fourier transform infrared (ATR FT-IR) spectroscopy, letting A be the absorbance peak height near a wave number of 1700±40 $cm^{-1}$ (height of absorbance peak attributed to carboxylic acid) and B be the absorbance peak height near a wave number of 1550±40 $cm^{-1}$ (height of absorbance peak attributed to metal carboxylate), the value expressed as A/(A+B) at some or all of the surface sites is at least 0.4.

In a preferred embodiment of the golf ball according to the first aspect of the invention, in the envelope layer-forming resin composition, the thermoplastic resin having a structure that includes α,β-ethylenically unsaturated carboxylic acid copolymerization units is an ionomer resin.

In another preferred embodiment of the golf ball of the invention, the α,β-unsaturated metal carboxylate included in the core outermost layer is zinc acrylate.

In yet another preferred embodiment of the inventive golf ball, the core has a hardness difference between a center and surface thereof which is at least 13 on the JIS-C hardness scale.

In a second aspect, the invention provides a method for producing a golf ball having a core composed of one or more layer, which method includes the steps of forming an outermost layer of the core with a rubber composition containing a base rubber and an α,β-unsaturated metal carboxylate; surface-treating the core outermost layer by bringing an acid-containing solution into contact with a surface of the outermost layer; and forming an envelope layer by molding, over the surface-treated outermost layer of the core, a resin composition containing a thermoplastic resin having a structure that includes α,β-ethylenically unsaturated carboxylic acid copolymerization units.

In a preferred embodiment of the production method according to the second aspect of the invention, the acid-containing solution is a hydrochloric acid-containing solution.

In another preferred embodiment of the production method of the invention, the acid-containing solution is an alcohol-containing solution.

In yet another preferred embodiment of the production method of the invention, the acid-containing solution, when brought into contact with the core outermost layer surface, has an acid concentration of at least 0.05 mol/L.

In still another preferred embodiment of the inventive production method, the surface of the acid-containing solution is brought into contact with the core outermost layer by dipping the core in the acid-containing solution.

Advantageous Effects of the Invention

In the golf ball of the invention, adhesion between the rubber-based core and the cover layer which directly encases the core and is formed of a resin material containing an α,β-ethylenically unsaturated carboxylic acid copolymer such as an ionomer resin can be improved. In particular, when a core having a large hardness difference between the core surface and core center is used, the golf ball's durability at impact can be greatly improved. Also, the golf ball production method of the invention carries out a specific surface treatment on the core outermost layer obtained by molding a rubber composition under applied heat, thereby demetallizing metal salts present at the core surface. In this way, golf balls having a sufficiently improved durability can be obtained by a relatively simple method without adversely affecting golf ball properties such as the flight performance and the spin performance.

BRIEF DESCRIPTION OF THE DIAGRAMS

FIG. 1 is a chart of infrared absorption spectra at surface sites on a golf ball core serving to illustrate absorbance peak height A (height of absorbance peak attributed to carboxylic acid) and absorbance peak height B (height of absorbance peak attributed to metal carboxylate).

DESCRIPTION OF THE PREFERRED EMBODIMENTS

The objects, features and advantages of the invention will become more apparent from the following detailed description taken in conjunction with the appended diagram.

The golf ball of the invention has a core composed of one or more layer. That is, the core in this invention may be a single-layer core or may be a multilayer core such as two-layer core having an inner layer and an outer layer.

The outermost layer of the core is formed of a rubber composition which includes a base rubber and an α,β-unsaturated metal carboxylate. Preferred examples of this rubber composition include rubber compositions formulated as described below.

The base rubber is not particularly limited, although the use of polybutadiene is especially preferred.

It is desirable for the polybutadiene to have a cis-1,4-bond content on the polymer chain of at least 60 wt %, preferably at least 80%, more preferably at least 90 wt %, and most preferably at least 95 wt %. At a cis-1,4-bond content among the bonds on the polybutadiene molecule that is too low, the rebound may decrease.

The polybutadiene has a content of 1,2-vinyl bonds on the polymer chain which is generally not more than 2 wt %, preferably not more than 1.7 wt %, and more preferably not more than 1.5 wt %. At a 1,2-vinyl bond content which is too high, the rebound may decrease.

The polybutadiene has a Mooney viscosity ($ML_{1+4}$ (100° C.)) of preferably at least 20, and more preferably at least 30. The upper limit is preferably not more than 120, more preferably not more than 100, and even more preferably not more than 80.

The term "Mooney viscosity" used herein refers to an industrial indicator of viscosity (JIS K 6300) measured with a Mooney viscometer, which is a type of rotary plastometer. This value is represented by the unit symbol $ML_{1+4}$ (100° C.), wherein "M" stands for Mooney viscosity, "L" stands for large rotor (L-type) and "1+4" stands for a pre-heating time of 1 minute and a rotor rotation time of 4 minutes. The "100° C." indicates that measurement was carried out at a temperature of 100° C.

The polybutadiene used may be one synthesized with a rare-earth catalyst or a group VIII metal compound catalyst.

A polybutadiene rubber synthesized with a catalyst other than the above rare-earth catalysts may be included in the base rubber. Other rubber ingredients such as styrene-butadiene rubber (SBR), natural rubber, polyisoprene rubber and ethylene-propylene-diene rubber (EPDM) may also be included. These rubber ingredients may be used alone or two or more may be used in combination.

The polybutadiene accounts for a proportion of all the base rubber in the rubber composition which is preferably at least 60 wt %, more preferably at least 70 wt %, and most preferably at least 90 wt %. It is also possible for 100 wt % of the base rubber, i.e., all of the base rubber, to be polybutadiene.

The α,β-unsaturated metal carboxylate is generally used as a co-crosslinking agent. The number of carbon atoms on this unsaturated carboxylic acid is preferably from 3 to 8. Specific examples include unsaturated carboxylic acids such as acrylic acid, methacrylic acid, maleic acid and fumaric acid. Specific examples of the metal in the unsaturated metal carboxylate include zinc, sodium, magnesium, calcium and aluminum, with zinc being especially preferred. The co-crosslinking agent is most preferably zinc acrylate.

The α,β-unsaturated metal carboxylate can be mixed as a metal salt with the base rubber, or may be obtained by chemically reacting, within the base rubber, an α,β-unsaturated carboxylic acid with a metal source such as a metal oxide. In cases where the α,β-unsaturated metal carboxylate is obtained from this chemical reaction, it is preferable to react an amount of the metal constituent sufficient to convert acid groups on the α,β-unsaturated carboxylic acid into a metal salt. When the amount of the metal constituent is insufficient, the hardness of the core obtained may decrease or the rebound may decline.

The content of the α,β-unsaturated metal carboxylate per 100 parts by weight of the base rubber may be set to preferably at least 5 parts by weight, more preferably at least 10 parts by weight, and even more preferably at least 15 parts by weight. The upper limit in the content may be set to preferably not more than 60 parts by weight, more preferably not more than 50 parts by weight, and even more preferably not more than 45 parts by weight. When the content is too high, the ball may become too hard, resulting in an unpleasant feel at impact. When the content is too low, the rebound may decrease.

In addition to the above essential ingredients, the rubber composition may also include a co-crosslinking agent other than the above, an organic peroxide, an inert filler, sulfur, an antioxidant, an organosulfur compound and the like.

In cases where the core is composed of a single layer, the single-layer core can be produced from the above-described rubber composition. In cases where the core is composed of a plurality of layers, the material making up the center core may be a rubber material of the same type as that in the outermost layer described above, or the center core may instead be made of a rubber composition in which the types and contents of the compounding ingredients differ from the above or may be made of a known resin material.

A vulcanizate (core) can be produced by vulcanizing/curing the above rubber composition. This vulcanizate may be used as part or all of the single-layer or multilayer core. For example, the core which is a vulcanizate can be produced by using a mixing apparatus such as a Banbury mixer or a roll mill to knead the rubber composition, compression-molding or injection-molding the kneaded composition using a core mold, and suitably heating the molded body at a temperature sufficient for the organic peroxide and co-crosslinking agent to act, such as between about 100° C. and 200° C. for 10 to 40 minutes so as to cure the molded body.

In order to be able to increase the durability of the golf ball while maintaining good spin properties, it is preferable for the core to have a hardness profile in which the hardness difference between the surface and the center is large.

The core center hardness on the JIS-C hardness scale, although not particularly limited, is preferably at least 30, more preferably at least 40, and even more preferably at least 50. The upper limit is preferably not more than 80, more preferably not more than 70, and even more preferably not more than 60. At a core center hardness outside of this range, the feel at impact may worsen or the durability may decrease, and a spin rate-lowering effect may not be obtainable.

The core surface hardness on the JIS-C hardness scale, although not particularly limited, is preferably at least 50, more preferably at least 60, and even more preferably at least 70. The upper limit is preferably not more than 98, more preferably not more than 96, and even more preferably not more than 94. At a core surface hardness that is lower than this range, the ball rebound may decrease and a sufficient distance may not be obtained. On the other hand, at a core surface hardness that is higher than this range, the feel at impact may become too hard or the durability to cracking under repeated impact may worsen.

With regard to the core hardness profile, from the standpoint of the ball spin performance, it is preferable for the hardness difference between the core surface and the core center to be large. Specifically, the hardness difference between the core surface and core center, expressed on the JIS-C hardness scale, is preferably at least 13, more preferably at least 20, and even more preferably at least 25. The upper limit is preferably not more than 60, more preferably not more than 50, and even more preferably not more than 40. When the hardness difference is too small, the spin rate-lowering effect on shots with a driver (W #1) may be inadequate and a good distance may not be achieved. On the other hand, when the hardness difference is too large, the initial velocity of the ball on actual shots may decrease and a good distance may not be obtained, or the durability to cracking on repeated impact may worsen. As used herein, "center hardness" refers to the hardness measured at the center of the cross-section obtained by cutting the core in half through the center, and "surface hardness" refers to the hardness measured at the spherical surface of the core. Also, "JIS-C hardness" refers to the hardness measured with the spring-type durometer (JIS-C model) specified in JIS K 6301-1975.

The core diameter is not particularly limited and depends also on the layer structure of the golf ball to be produced, but is preferably at least 30 mm, and more preferably at least 35. The upper limit is preferably not more than 41 mm, and more preferably not more than 40 mm. When the core diameter falls outside of this range, the initial velocity of the ball may decrease or a suitable spin performance may not be obtained.

In the practice of this invention, when the infrared absorption spectra at surface sites on the outermost layer of the core are measured by attenuated total reflectance Fourier transform infrared (ATR FT-IR) spectroscopy, letting A be the absorbance peak height near a wave number of 1700±40 $cm^{-1}$ (height of absorbance peak attributed to carboxylic acid) and B be the absorbance peak height near a wave number of 1550±40 $cm^{-1}$ (height of absorbance peak attributed to metal carboxylate), the value expressed as A/(A+B) at some or all of the surface sites must be at least 0.4, and is preferably at least 0.5, and more preferably at least 0.6. When this value is less than 0.4, that is, when the height of the absorbance peak attributed to carboxylic acid is relatively low, adhesion with the envelope layer that directly encases the core worsens.

Measurement in the above ATR FT-IR spectroscopy may be carried out in accordance with JIS K0117 (2000).

In order to set the value expressed as A/(A+B) to 0.4 or more, although not particularly limited, it is preferable to carry out surface treatment of the outermost layer of the core by bringing an acid-containing solution into contact with the surface of the core outermost layer. Generally, following hot molding of the core-forming rubber composition, unsaturated carboxylic acid is neutralized with metal ions owing to the inclusion of a co-crosslinking agent such as zinc acrylate, and so the level of free unsaturated carboxylic acid is not high. It is thought that by bringing an acid-containing solution into contact with the surface of the core outermost layer, a sufficient amount of demetallized carboxyl groups form only at the surface portion and new chemical bonds form with acid group-neutralizing metal ions present in the adjoining envelope layer, so that adhesion improves compared with the absence of such treatment.

The chart in FIG. 1 shows a case in which the infrared absorption spectrum at a core surface site changes due to surface treatment. The absorbance peak height A' near a wave number of 1700±40 $cm^{-1}$ representing an absorbance peak attributed to carboxylic acid increases after surface treatment of the core, changing to the absorbance peak height A position. Also, the absorbance peak height B' near a wave number of 1550±40 $cm^{-1}$ representing an absorbance peak attributed to metal carboxylate decreases after surface treatment of the core, changing to the absorbance peak height B position.

The acid used in acid treatment is not particularly limited, so long as it is an acid which can remove metal ions from the α,β-unsaturated metal carboxylate at the surface of the core outermost layer and protonize a carboxylic acid. Illustrative examples include hydrochloric acid, sulfuric acid and nitric acid. In particular, from the standpoint of the ease of carrying out the operation, the use of hydrochloric acid is preferred. The acid concentration when used, although not particularly limited, is preferably at least 0.05 mol/L, and more preferably at least 0.1 mol/L. The upper limit is preferably not more than 10 mol/L, more preferably not more than 5 mol/L, even more preferably not more than 3 mol/L, and most preferably not more than 1 mol/L. When the acid concentration is too low, an adhesion-improving effect between the core surface and the envelope layer may not be observed. When the acid concentration is too high, this may adversely impact the bull properties rather than enhancing the core surface properties.

For the acid to better penetrate to the interior of the rubber or resin serving as the core material and for increased affinity, it is preferable for the acid-containing solution to include also an alcohol. As a result, demetallization treatment of the metal salt at the core surface due to acid treatment can be made to proceed rapidly. The alcohol used is preferably a lower alcohol having up to four carbon atoms, such as ethanol or 2-propanol.

The acid treatment method used is preferably one that involves subjecting surface regions of the core outermost layer to dipping, painting (spraying), infiltration under applied heat and pressure, dropwise application or the like. The use of a dipping method is especially preferred. For example, when the core is dipped in an acid-containing solution, dipping may be carried out for a period of from 1 to 60 minutes, especially 1 to 10 minutes.

The acid treatment temperature may be set to between 10° C. and 30° C., and especially between 20° C. and 25° C.; room temperature or atmospheric temperature generally suffices. Following acid treatment (acid washing), washing may be carried out in which the core is thoroughly rinsed with water so that acid does not remain on the surface. The water rinsing method is not particularly limited. For example, use can be made of a method such as washing with a large amount of water.

Prior to the above acid treatment, it is preferable to abrade the surface of the core outermost layer. The method of abrasion is exemplified by a process that involves randomly rotating the core in a diamond grinding wheel, a process that uses diamond paper, and a sandblasting process.

The golf ball of the invention has an envelope layer which directly encases the core. This envelope layer makes up part or all of the cover. That is, in cases where the cover consists of a single layer, this envelope layer (cover layer) serves as the outermost layer in the layer structure of the golf ball. In cases where the cover is composed of a plurality of layers, one or more additional cover layer is formed on the outside of this envelope layer.

The envelope layer is formed of a resin composition having a thermoplastic resin with a structure that includes α,β-ethylenically unsaturated carboxylic acid copolymerization units.

The thermoplastic resin having a structure that includes α,β-ethylenically unsaturated carboxylic acid copolymerization units is not particularly limited, although it is preferably one which includes either (a) an ethylene-α,β-unsaturated carboxylic acid copolymer and/or a metal salt thereof or (b) an ethylene-α,β-unsaturated carboxylic acid-α,β-unsaturated carboxylic acid ester copolymer and/or a metal salt thereof.

Specific examples of the α,β-unsaturated carboxylic acid in components (a) and (b) include acrylic acid, methacrylic acid, maleic acid and fumaric acid. Acrylic acid and methacrylic acid are especially preferred. The α,β-unsaturated carboxylic acid ester in component (b) is preferably a lower alkyl ester of the above unsaturated carboxylic acid, specific examples of which include methyl methacrylate, ethyl methacrylate, propyl methacrylate, butyl methacrylate, methyl acrylate, ethyl acrylate, propyl acrylate and butyl acrylate. Butyl acrylate (butyl n-acrylate, butyl i-acrylate) is especially preferred.

Metal ion neutralization products of the copolymers in components (a) and (b) can be obtained by partially neutralizing acid groups in the olefin-unsaturated carboxylic acid copolymer or the olefin-unsaturated carboxylic acid-unsaturated carboxylic acid ester copolymer with metal ions. Illustrative examples of metal ions which neutralize the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Preferred use can be made of $Na^+$, $Li^+$, $Zn^{++}$, $Mg^{++}$ and $Ca^{++}$ in particular. Such neutralization products may be obtained by a known method. For example, a neutralization product may be obtained by using, for reaction with the above copolymer, a compound such as a formate, acetate, nitrate, carbonate, bicarbonate, oxide, hydroxide or alkoxide of the above metal ion.

Known substances may be used as components (a) and (b). Illustrative examples include commercial products such as the following acid copolymers: Nucrel® N1560, Nucrel® N1214, Nucrel® N1035, Nucrel® AN4221C, Nucrel® AN4311, Nucrel® AN4318 and Nucrel® AN4319 (all products of Dow-Mitsui Polychemicals Co., Ltd.). Illustrative examples of metal ion neutralization products of acid copolymers include Himilan® 1554, Himilan® 1557, Himilan® 1601, Himilan® 1605, Himilan® 1706, Himilan® AM7311, Himilan® 1855, Himilan® 1856 and Himilan® AM7316 (all products of Dow-Mitsui Polychemicals Co., Ltd.), and Surlyn® 7930, Surlyn® 6320, Surlyn® 38320, Surlyn® 9320 and Surlyn® 8120 (E.I. DuPont de Nemours and Company).

The resin composition in the envelope layer may also suitably include known resins other than the above thermoplastic resin having a structure that includes α,β-ethylenically unsaturated carboxylic acid copolymerization units, and various types of additives.

In cases where the cover has a plurality of layers, one or more other cover layer may additionally be formed outside of this envelope layer. A known thermoplastic resin or thermoplastic elastomer, such as an ionomer or a thermoplastic polyurethane elastomer, may be used as the chief material in this cover layer.

The method used to obtain the cover layers (envelope layer, and cover layers other than the envelope layer) in this invention may be, for example, a method in which, depending on the type of ball being produced, a pre-fabricated single-layer core or multilayer core of two or more layers is placed in a mold and the above mixture is mixed and melted under heating and then injection-molded over the core, thereby encasing the core with the desired cover layer or layers. Another method that may be used to form the cover layers involves molding the cover material into a pair of hemispherical half-cups, enclosing the core with these half-cups, and then molding under applied pressure at between 120° C. and 170° C. for 1 to 5 minutes.

When the cover is a one-layer cover, that is, when the cover is composed of only an envelope layer, the thickness of that layer may be set to from 0.3 to 3 mm. When the cover is composed of two layers, the cover layer outside of the envelope layer (i.e., the outermost layer) may be set to a thickness of from 0.3 to 2.0 mm and the envelope layer (inner cover layer) may be set to a thickness of from 0.3 to 2.0 mm. The cover layers making up the cover each have a Shore D hardness which, although not particularly limited, is preferably at least 40, and more preferably at least 45, but is preferably not more than 70, and more preferably not more than 65.

Numerous dimples may be formed on the surface of the outermost layer of the cover. Also, various types of treatment, such as surface preparation, stamping and painting, may be carried out on the surface of the cover outermost layer.

EXAMPLES

The following Examples of the invention Comparative Examples are provided to illustrate the invention, and are not intended to limit the scope thereof.

Examples 1 to 5, Comparative Examples 1 to 4

Using the three types of core materials (X, Y, Z) composed primarily of polybutadiene shown in Table 1 below, core compositions having the rubber formulations shown in Table 1 are prepared. The core compositions are subjected to 20 minutes of vulcanization at 155° C., and the core surface is abraded, thereby producing 38.6 mm-diameter cores.

TABLE 1

| | Type of core | X | Y | Z |
|---|---|---|---|---|
| Core formulation (pbw) | Polybutadiene | 100 | 100 | 100 |
| | Zinc acrylate | 40 | 26 | 25 |
| | Organic peroxide | 1 | 1 | 1 |
| | Zinc oxide | 15.4 | 21.1 | 21.4 |
| | Propylene glycol | | 1 | |
| | Water | 1 | | |
| | Antioxidant (1) | 0.2 | | 0.2 |
| | Antioxidant (2) | | 0.3 | |
| Core properties | Diameter (mm) | 38.6 | 38.6 | 38.6 |
| | Weight (g) | 35.0 | 35.0 | 35.0 |
| | Compressive hardness (mm) | 4.03 | 4.01 | 4.05 |
| | Surface hardness A (JIS-C) | 76.8 | 80.4 | 70.5 |
| | Center hardness B (JIS-C) | 53.1 | 54.2 | 56.6 |
| | Hardness difference A-B (JIS-C) | 23.7 | 26.2 | 13.9 |

Details on the above formulations are given below.

Polybutadiene: Available under the trade name "BR 01" from JSR Corporation

Zinc acrylate: Available under the trade name "ZN-DA85S" (85% zinc acrylate/15% zinc stearate) from Nippon Shokubai Co., Ltd.

Organic peroxide (dicumyl peroxide): Available under the trade name "Percumyl D" from NOF Corporation Zinc oxide: Available as "Zinc Oxide Grade 3" from Sakai Chemical Co., Ltd.

Propylene glycol (a dihydric alcohol): molecular weight, 76.1 (from Hayashi Pure Chemical Ind., Inc.)

Water: Distilled water

Antioxidant (1): Available under the trade name "Nocrac NS-6" from Ouchi Shinko Chemical Industry Co., Ltd.

Antioxidant (2): Available under the trade name "Nocrac MB" from Ouchi Shinko Chemical Industry Co., Ltd.

Center and Surface Hardnesses of Core

The surface and center hardnesses of the three above types of 38.6 mm-diameter cores are measured by the following methods.

At a temperature of 23±° C., the hardnesses at four random points on the core surface are measured with a JIS-C durometer by perpendicularly setting the durometer indenter against the spherical surface of the core. The average value of these measurements is treated as the measured value for one core, and the average value for three measured cores is determined. Also, the core is cut through the center to obtain a flat cross-section. At a temperature of 23±1° C., the center hardness of the hemispherical core is measured with a JIS-C durometer by perpendicularly setting the durometer indenter against the flat cross-section, thereby obtaining the measurement for one core. The average value for three measured cores is determined. These measurements are presented in Table 1.

Compressive Hardnesses of Core

The compressive hardness (deformation)(mm) of each core when compressed at a rate of 10 mm/s under a final load of 1,275 N (130 kgf) from an initial load state of 98 N (10 kgf) is measured at a temperature of 23±1° C. The average value for ten measured cores is determined.

Surface Treatment of Core

The following five types of surface treatment are carried out on the three above types of cores.

Core surface treatment (1): After being abraded, the core is washed with water.

Core surface treatment (2): After being abraded, the core is washed with an ethanol solution.

Core surface treatment (3): After being abraded, the core is dipped for 3 minutes at 23° C. in a 0.1 mol/L aqueous hydrochloric acid solution, following which the dipped core is washed with an ethanol solution.

Core surface treatment (4): After being abraded, the core is dipped for 3 minutes at 23° C. in a 1 mol/L hydrochloric acid 2-propanolic treatment solution, following which the dipped core is washed with an ethanol solution.

Core surface treatment (5): After being abraded, the core is dipped for 3 minutes at 23° C. in a 0.1 mol/L hydrochloric acid 2-propanolic treatment solution, following which the dipped core is washed with an ethanol solution.

FT-IR Absorbance

Determinations for the surface portion of the core subjected to above Surface Treatments (1) to (5) in the respective golf balls obtained in the Examples of the invention and the Comparative Examples are carried out by cutting out a section of the core and measuring the infrared absorption spectra (as a chart of absorbance versus wave number) at surface sites on the core using ATR FT-IR spectroscopy.

The instrument employed for FT-IR measurement is the Perkin Elmer Spectrum 100/Universal ATR (Diamond/

ZnSe) Fourier-transform infrared spectrophotometer from Perkin Elmer. Samples are measured under the following conditions.

Measurement method: Attenuated total reflection (ATR)

Resolution: 4 $cm^{-1}$

Number of runs: 4

Measurement wave number range: 4000 $cm^{-1}$ to 650 $cm^{-1}$

Place of measurement: Core surface sites

Data processing software: Perkin Elmer software package/Spectrum Version 6.3.4.0164

Formation of Envelope Layer and Outermost Layer

Next, using an injection mold, the envelope layer material (ionomer resin material) shown in Table 2 is injection-molded over the core surface, thereby forming an envelope layer having a thickness of 1.25 mm and a Shore D hardness of 64. Using a different injection mold, the outermost layer material (urethane resin material) shown in Table 2 is then injection-molded over the envelope layer-encased sphere, thereby forming an outermost layer having a thickness of 0.8 mm and a Shore D hardness of 41.

TABLE 2

| Compounding ingredients (pbw) | Envelope layer | Outermost layer |
|---|---|---|
| Himilan 1706 | 35 | |
| Himilan 1557 | 15 | |
| Himilan 1605 | 50 | |
| TPU | | 100 |
| Polyethylene wax | | 1.0 |
| Isocyanate compound | | 6.3 |
| Titanium oxide | | 3.3 |
| Trimethylolpropane | 1.1 | |

sive hardness and durability to cracking for all of the balls are measured after letting the manufactured balls stand for one month at 23° C. following completion.

Compressive Hardness of Ball

The compressive hardness (deformation)(mm) of the golf ball in each Example when compressed at a speed of 10 mm/s under a final load of 1,275 N (130 kgf) from an initial load state of 98 N (10 kgf) is measured at a temperature of 23±1° C. In each case, the average value for ten measured balls is determined.

Durability to Cracking

The durability of the golf ball is evaluated using an ADC Ball COR Durability Tester produced by Automated Design Corporation (U.S.). This tester fires a golf ball pneumatically and causes it to consecutively strike two metal plates arranged in parallel. The incident velocity against the metal plates is set to 43 m/s. The number of shots required for the golf ball to crack is measured, and the average value of the measurements taken for ten golf balls is calculated. Durability indices for the balls in the respective Examples are calculated relative to an arbitrary index of 100 for the average number of shots required for the ball obtained in Comparative Example 1 to crack and are shown in Table 3.

TABLE 3

| | | | Example | | | | | Comparative Example | | | |
|---|---|---|---|---|---|---|---|---|---|---|---|
| | | | 1 | 2 | 3 | 4 | 5 | 1 | 2 | 3 | 4 |
| Core (before surface treatment) | Type | | X | X | X | Y | Z | X | Y | Z | X |
| | Compressive hardness (mm) | | 4.03 | 4.03 | 4.03 | 4.01 | 4.05 | 4.03 | 4.01 | 4.05 | 4.03 |
| | Absorbance | A: 1700 $cm^{-1}$ | 0.011 | 0.011 | 0.011 | 0.007 | 0.007 | 0.011 | 0.007 | 0.007 | 0.011 |
| | | B: 1550 $cm^{-1}$ | 0.106 | 0.106 | 0.106 | 0.069 | 0.072 | 0.106 | 0.069 | 0.072 | 0.106 |
| | | A/(A + B) | 0.094 | 0.094 | 0.094 | 0.092 | 0.089 | 0.094 | 0.092 | 0.089 | 0.094 |
| | Core surface treatment | | (3) | (4) | (5) | (5) | (5) | (1) | (1) | (1) | (2) |
| Core (after surface treatment) | Absorbance | A: 1700 $cm^{-1}$ | 0.047 | 0.081 | 0.062 | 0.040 | 0.035 | 0.011 | 0.007 | 0.007 | 0.011 |
| | | B: 1550 $cm^{-1}$ | 0.059 | 0.015 | 0.049 | 0.033 | 0.031 | 0.106 | 0.069 | 0.072 | 0.105 |
| | | A/(A + B) | 0.443 | 0.844 | 0.559 | 0.548 | 0.530 | 0.094 | 0.092 | 0.089 | 0.095 |
| Ball | Compressive hardness (mm) | | 3.26 | 3.26 | 3.26 | 3.24 | 3.30 | 3.26 | 3.24 | 3.30 | 3.26 |
| | Durability to cracking (index) | | 108 | 114 | 112 | 112 | 113 | 100 | 103 | 109 | 100 |

Details on the compounding ingredients in this table are given below.

Himilan 1706, Himilan 1557, Himilan 1605:

Ionomer resins available from Dow-Mitsui Polychemicals Co., Ltd.

TPU: An ether-type thermoplastic polyurethane available under the trade name "Pandex" from DIC Covestro Polymer, Ltd.; Shore D hardness, 41

Polyethylene wax: Available under the trade name "Sanwax 161P" from Sanyo Chemical Industries, Ltd.

Isocyanate compound: 4,4'-Diphenylmethane diisocyanate

The compressive hardness and durability to cracking of the resulting golf balls are evaluated by the following methods. The results are presented in Table 3. The compres- Japanese Patent Application No. 2019-230467 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for producing a golf ball having a core composed of one or more layer, which method comprises the steps of:

forming an outermost layer of the core with a rubber composition containing a base rubber and an α,β-unsaturated metal carboxylate;

surface-treating the core outermost layer by bringing an acid-containing solution into contact with a surface of the outermost layer; and forming an envelope layer by molding, over the surface-treated outermost layer of the core, a resin composition containing a thermoplastic resin having a structure that includes α,β-ethylenically unsaturated carboxylic acid copolymerization units;

wherein the acid-containing solution consists of aqueous hydrochloric acid solution.

2. The method of claim 1, wherein the acid-containing solution, when brought into contact with the surface of the core outermost layer, has an acid concentration of at least 0.05 mol/L.

3. The method of claim 1, wherein the surface of the acid-containing solution is brought into contact with the core outermost layer by dipping the core in the acid-containing solution.

4. The method of claim 1, wherein when the infrared absorption spectra at surface sites on the surface-treated outermost layer of the core are measured by attenuated total reflectance Fourier transform infrared (ATR FT-IR) spectroscopy, letting A be the absorbance peak height near a wave number of 1700±40 $cm^{-1}$ (height of absorbance peak attributed to carboxylic acid) and B be the absorbance peak height near a wave number of 1550±40 $cm^{-1}$ (height of absorbance peak attributed to metal carboxylate), the value expressed as A/(A+B) at some or all of the surface sites is at least 0.4.

5. A method for producing a golf ball having a core composed of one or more layer, which method comprises the steps of:

forming an outermost layer of the core with a rubber composition containing a base rubber and an α,β-unsaturated metal carboxylate;

surface-treating the core outermost layer by bringing an acid-containing solution into contact with a surface of the outermost layer; and forming an envelope layer by molding, over the surface-treated outermost layer of the core, a resin composition containing a thermoplastic resin having a structure that includes α,β-ethylenically unsaturated carboxylic acid copolymerization units;

wherein the acid-containing solution consists of an alcohol.

6. The method of claim 5, wherein the acid-containing solution, when brought into contact with the surface of the core outermost layer, has an acid concentration of at least 0.05 mol/L.

7. The method of claim 5, wherein the surface of the acid-containing solution is brought into contact with the core outermost layer by dipping the core in the acid-containing solution.

8. The method of claim 5, wherein when the infrared absorption spectra at surface sites on the surface-treated outermost layer of the core are measured by attenuated total reflectance Fourier transform infrared (ATR FT-IR) spectroscopy, letting A be the absorbance peak height near a wave number of 1700±40 $cm^{-1}$ (height of absorbance peak attributed to carboxylic acid) and B be the absorbance peak height near a wave number of 1550±40 $cm^{-1}$ (height of absorbance peak attributed to metal carboxylate), the value expressed as A/(A+B) at some or all of the surface sites is at least 0.4.

9. A method for producing a golf ball having a core composed of one or more layer, which method comprises the steps of:

forming an outermost layer of the core with a rubber composition containing a base rubber and an α,β-unsaturated metal carboxylate;

surface-treating the core outermost layer by bringing an acid-containing solution into contact with a surface of the outermost layer; and forming an envelope layer by molding, over the surface-treated outermost layer of the core, a resin composition containing a thermoplastic resin having a structure that includes α,β-ethylenically unsaturated carboxylic acid copolymerization units, wherein the acid-containing solution consists of a hydrochloric acid and an alcohol.

10. The method of claim 9, wherein the acid-containing solution, when brought into contact with the surface of the core outermost layer, has an acid concentration of at least 0.05 mol/L.

11. The method of claim 9, wherein the surface of the acid-containing solution is brought into contact with the core outermost layer by dipping the core in the acid-containing solution.

12. The method of claim 9, wherein the acid-containing solution consists of a hydrochloric acid and 2-propanol.

13. The method of claim 9, wherein when the infrared absorption spectra at surface sites on the surface-treated outermost layer of the core are measured by attenuated total reflectance Fourier transform infrared (ATR FT-IR) spectroscopy, letting A be the absorbance peak height near a wave number of 1700±40 cm-1 (height of absorbance peak attributed to carboxylic acid) and B be the absorbance peak height near a wave number of 1550±40 cm-1 (height of absorbance peak attributed to metal carboxylate), the value expressed as A/(A+B) at some or all of the surface sites is at least 0.4.

* * * * *